US007311571B1

(12) United States Patent
Swan et al.

(10) Patent No.: US 7,311,571 B1
(45) Date of Patent: Dec. 25, 2007

(54) HYDRAULIC STEERING DEVICE FOR A MARINE PROPULSION SYSTEM

(75) Inventors: Allen F. Swan, Beaver Dam, WI (US); Daniel P. Klawitter, Beaver Dam, WI (US); Darin C. Uppgard, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 20 days.

(21) Appl. No.: 11/454,660

(22) Filed: Jun. 16, 2006

(51) Int. Cl.
*B63H 5/125* (2006.01)

(52) U.S. Cl. ..... 440/61 S; 440/53

(58) Field of Classification Search ..... 440/61 S
See application file for complete search history.

(56) References Cited

U.S. PATENT DOCUMENTS

| | | | | |
|---|---|---|---|---|
| 4,041,889 | A | 8/1977 | Blanchard | 115/18 R |
| 5,127,856 | A | 7/1992 | Kabuto et al. | 440/60 |
| 5,244,426 | A | 9/1993 | Miyashita et al. | 440/60 |
| 6,183,321 | B1 | 2/2001 | Alby et al. | 440/61 |
| 6,276,977 | B1 | 8/2001 | Treinen et al. | 440/61 |
| 6,402,577 | B1 | 6/2002 | Treinen et al. | 440/61 |
| 6,406,340 | B1 | 6/2002 | Fetchko et al. | 440/61 |
| 6,761,599 | B2 * | 7/2004 | Ferguson | 440/61 S |
| 6,821,168 | B1 | 11/2004 | Fisher et al. | 440/61 R |
| 6,883,451 | B2 | 4/2005 | Takada et al. | 114/144 R |

* cited by examiner

*Primary Examiner*—Jesús D Sotelo
(74) *Attorney, Agent, or Firm*—William D. Lanyi

(57) ABSTRACT

A support device for a marine propulsion system, such as an outboard motor, provides a swivel bracket that is rotatable about a tilt axis relative to a transom bracket with a hydraulic cylinder formed as an integral part of the swivel bracket. A vertical plane in which a central axis of the hydraulic cylinder is disposed is positioned between and parallel to vertical planes in which the tilt axis and steering axis are disposed, respectively. The steering axis is rotatable about the tilt axis and a horizontal plane in which the central axis is disposed remains above a horizontal plane in which the tilt axis is disposed.

23 Claims, 8 Drawing Sheets

HYDRAULIC STEERING DEVICE FOR A MARINE PROPULSION SYSTEM

BACKGROUND OF THE INVENTION

1. Field of the Invention

The present invention generally relates to a support device for a marine propulsion system and, more particularly, to a hydraulic steering system that is attached to a swivel bracket of an outboard motor support device.

2. Description of the Related Art

Many different systems are known to those skilled in the art which provide a hydraulic steering actuator for use with outboard motors.

U.S. Pat. No. 4,041,889, which issued to Blanchard on Aug. 16, 1977, describes a marine propulsion device steering assembly. An outboard motor includes a lower unit comprising a propeller adapted for rotation under water and a swivel bracket adapted for mounting to a transom bracket for vertical tilting movement about a generally horizontal axis. A kingpin assembly including a pivot shaft is supported by the swivel bracket for rotation about a generally vertical axis, the pivot axis having fixed thereto a pinion and means for supporting the lower unit. A rack is located below the generally horizontal axis and engages the pinion.

U.S. Pat. No. 5,127,856, which issued to Kabuto et al. on Jul. 7, 1992, describes a power steering system for an outboard motor. A power steering system for an outboard motor capable of permitting an electric motor to be driven only when the driving of the electric motor is required and automatically controlling the steering force of a steering wheel depending upon the steering reaction force is described. The system is so constructed that a steering cable is moved depending upon the rotation of the steering wheel and the movement of the steering cable is detected by means of a steering force sensor, which supplies a signal to a controller. The controller controls the output of the electric motor depending upon the signal.

U.S. Pat. No. 5,244,426, which issued to Miyashita et al. on Sep. 14, 1993, describes a power steering system for an outboard motor. A power steering system for an outboard motor for steering an outboard motor disposed outside of a rear portion of a hull and usually including a manual steering system mounted upon the hull for operating a steering element so as to manually steer the outboard motor body is disclosed. A power unit is operatively connected to the manual steering system and includes an electric motor for applying a steering assist force to the manual steering system. The power unit is located at the portion of the hull capable of effectively utilizing the inner space of the hull and the electric motor of the power unit is controlled by means of a control unit in accordance with the navigation conditions of the hull and the operating conditions of the outboard motor as detected by means of suitable sensors. The sensors comprise various sensors such as, for example, a steering torque sensor and an engine speed sensor.

U.S. Pat. No. 6,183,321, which issued to Alby et al. on Feb. 6, 2001, discloses an outboard motor with a hydraulic pump and an electric motor located within a steering mechanism. It comprises a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,276,977, which issued to Treinen et al. on Aug. 21, 2001, discloses an integrated hydraulic steering actuator. The actuator is provided for an outboard motor system in which the cylinder and piston of the actuator are disposed within a cylindrical cavity inside a cylindrical portion of the swivel bracket. The piston within the cylinder of the actuator is attached to at least one rod that extends through clearance holes of a clamp bracket and is connected to a steering arm of the outboard motor. The one or more rods attached to the piston are aligned coaxially with an axis of rotation about which the swivel bracket rotates and the outboard motor is trimmed.

U.S. Pat. No. 6,402,577, which issued to Treinen et al. on Jun. 11, 2002, discloses an integrated hydraulic steering system for a marine propulsion unit. The system is provided in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a movable second portion of the steering actuator. The movable second portion of the steering actuator moves linearly within a cylinder cavity formed in a first portion of the steering actuator.

U.S. Pat. No. 6,406,340, which issued to Fetchko et al. on Jun. 18, 2002, describes a twin outboard motor hydraulic steering system. The assembly applies a force to the tiller arms of twin marine, outboard propulsion units and rotates the propulsion units about a steering axis between a center position and hard over positions to each side of the center position. Each propulsion unit is supported for arcuate movement about a tilt axis which is generally perpendicular to the steering axis. There is a hydraulic steering apparatus mounted on a first of the propulsion units which includes a hydraulic cylinder pivotally connected to a member which is pivotally mounted on the tiller arm of the first propulsion unit.

U.S. Pat. No. 6,821,168, which issued to Fisher et al. on Nov. 23, 2004, discloses a power steering system for a marine vessel. An outboard motor is provided with an internally contained cylinder and movable piston. The piston is caused to move by changes in differential pressure between first and second cavities within the cylinder. By adding a hydraulic pump and a steering valve, the hydraulic steering system described in U.S. Pat. No. 6,402,577 is converted to a power hydraulic steering system by adding a hydraulic pump and a steering valve to a manual hydraulic steering system.

U.S. Pat. No. 6,883,451, which issued to Takada et al. on Apr. 26, 2005, describes an outboard motor steering system. The steering system is for an outboard motor mounted on a stern of a boat with an internal combustion engine at is its upper portion and a propeller with a rudder at its lower portion powered by the engine to propel and steer the boat. The system includes a swivel shaft connected to the propeller to turn it relative to the boat, a swivel case fixed to the outboard motor and rotatably accommodating the swivel shaft, and a hydraulic actuator connected to the swivel shaft to rotate it. The actuator has a shape whose height is larger than its width and is installed in such a manner that a direction of the height is in parallel with a vertical direction, so as not to project outside a profile of the outboard motor, obtained by looking down the outboard motor from downward, regardless of a steering angle of the outboard motor.

The patents described above are hereby expressly incorporated by reference in the description of the present invention.

SUMMARY OF THE INVENTION

A marine propulsion system support device, made in accordance with a preferred embodiment of the present invention, comprises a swivel bracket, a swivel tube rotatably supported by the swivel bracket, a transom bracket which is attachable to a marine vessel, a steering cylinder attached to the swivel bracket, a piston disposed within the steering cylinder, and a steering arm attached to the swivel tube. The swivel bracket is supported by the transom bracket for rotation about a tilt axis. The steering axis is rotatable about the tilt axis. The piston is movable within the steering cylinder along a path which is parallel to a central axis of the steering cylinder. The steering arm is movable by the piston to cause the swivel tube to rotate about the steering axis relative to the swivel bracket. The tilt axis is disposed within a generally vertical tilt plane, the central axis of the steering cylinder is disposed within a central plane, and the steering axis is disposed within a steering plane. The steering plane is generally parallel to the tilt plane and the central plane is disposed between the tilt plane and steering plane when the central plane is generally vertical.

In a particularly preferred embodiment of the present invention, it further comprises an engine that is supported by the swivel bracket for rotation about a steering axis. The steering arm is attached to the engine.

In a preferred embodiment of the present invention, the central axis is disposed in a generally horizontal first plane and the tilt axis is disposed in a generally horizontal second plane. The first plane is disposed above the second plane.

The engine is attached for support to the swivel tube and the steering arm is attached to the swivel tube. The steering cylinder is formed as an integral portion of the swivel bracket in a particularly preferred embodiment of the present invention. The tilt plane is generally parallel to the central plane when the steering axis is generally vertical.

BRIEF DESCRIPTION OF THE DRAWINGS

The present invention will be more fully and clearly understood from a reading of the description of the preferred embodiment of the present invention in conjunction with the drawings, in which.

DESCRIPTION OF THE PREFERRED EMBODIMENT

Figure 1:
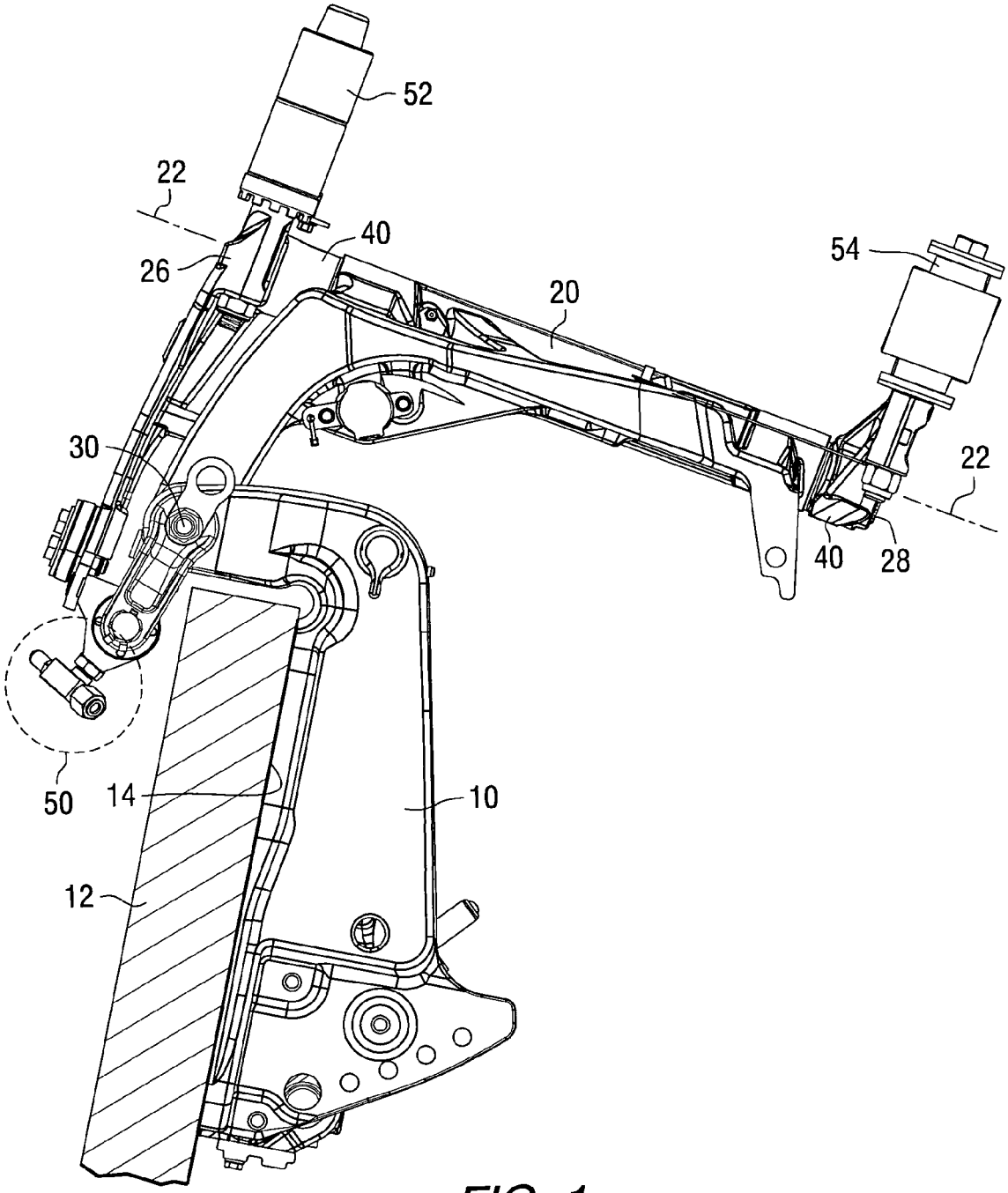
FIG. 1 PRIOR ART
FIG. 1 is a side view of a known type of support device for an outboard motor.

Throughout the description of the preferred embodiment of the present invention, like components will be identified by like reference numerals.

FIG. 1 illustrates a known support device for a marine propulsion system. A transom bracket 10 is configured to be attached to a transom 12 of a marine vessel. The illustration in FIG. 1 shows the transom bracket 10 attached to a rear surface 14 of the transom 12. A swivel bracket 20 is rotatably attached to the transom bracket 10 for rotation about a tilt axis 30. A swivel tube 40 is rotatably supported by the swivel bracket 20 for rotation about a steering axis 22. The swivel tube comprises an upper end 26 and a lower end 28 which are attached to opposite ends of an internal tube that is disposed within a cylindrical cavity of the swivel bracket 20. That internal tube is not visible in FIG. 1. The steering axis 22 is rotatable, as shown in FIG. 1, about the tilt axis 30.

In the region generally identified by dashed circle 50, support devices known to those skilled in the art typically attach a hydraulic cylinder and piston that is used to exert a steering force on an outboard motor. In known types of support devices for outboard motors, the marine propulsion device is supported by bolts attached to the mounts which are identified by reference numerals 52 and 54 in FIG. 1. The outboard motor tilts with the swivel bracket 20 and rotates about the steering axis 22 with the swivel tube 40.

With continued reference to FIG. 1, it can be seen that the hydraulic steering actuator, typically located in the area identified by the dashed circle 50, moves into the area of the marine vessel in front of the transom 12 when the swivel bracket 20 is rotated upwardly about the tilt axis 30 to a position similar to that illustrated in FIG. 1.

Figure 2:
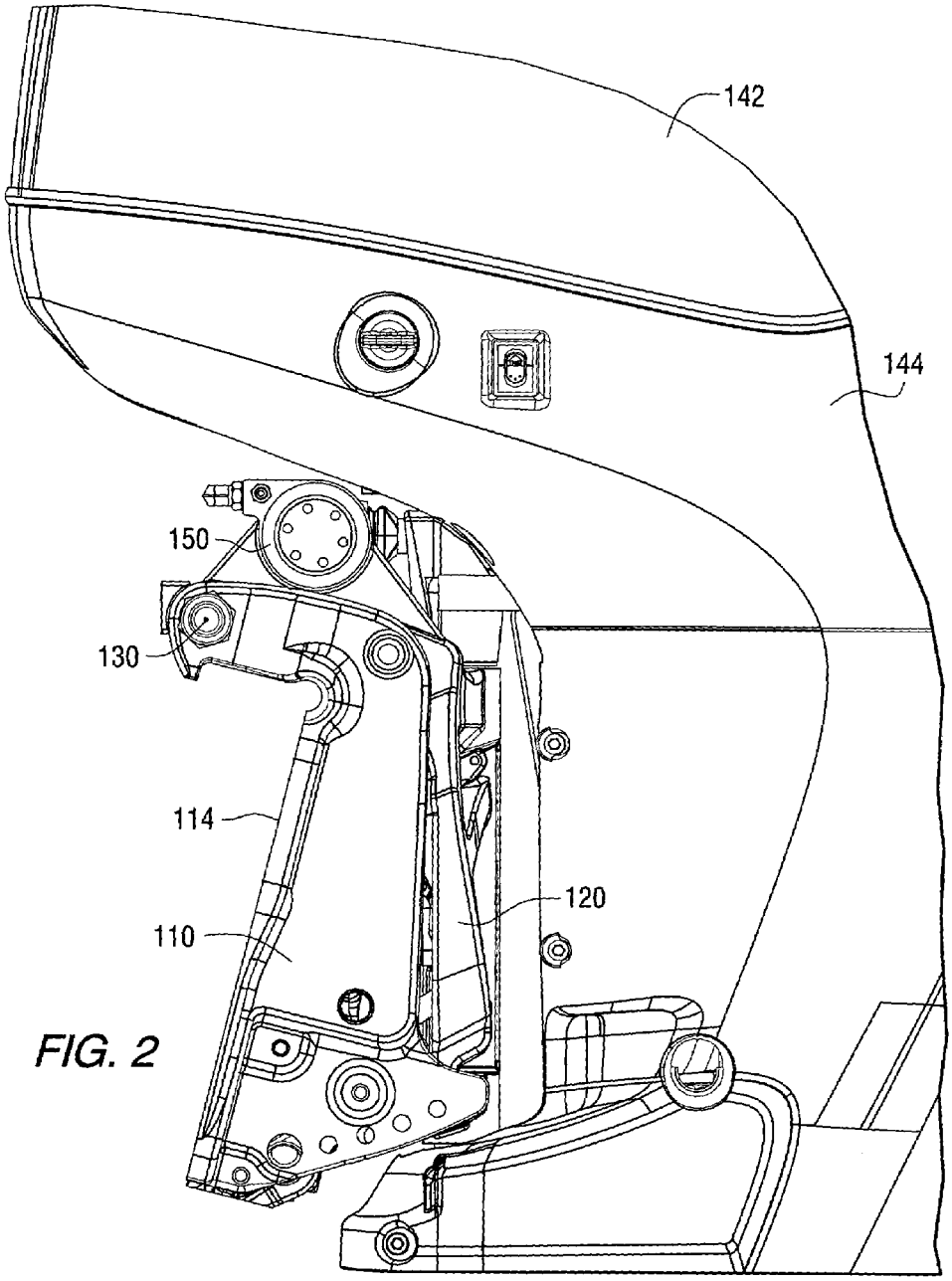
FIG. 2 is a side view of the present invention and the cowl portions of an outboard motor.

FIG. 2 shows a preferred embodiment of the present invention which comprises a transom bracket 110 with a surface 114 that is configured to be attached to a rear surface of a transom, such as the rear surface 14 of the transom 12 described above in conjunction with FIG. 1. A swivel bracket 120 is attached to the transom bracket 110 for rotation about the tilt axis 130. A swivel tube is rotatably supported by the swivel bracket 120 and attached to an outboard motor as shown in FIG. 2. An upper cowl 142 and a lower cowl 144 represent an outboard motor of the type that is generally known to those skilled in the art. Although not specifically illustrated in FIG. 2, an engine is contained under the cowl 142 in a manner that is well known in the prior art. The particular type and configuration of the engine of the outboard motor is not limiting to the present invention and is not shown in detail in FIG. 2.

With continued reference to FIG. 2, a steering cylinder 150 is attached to the swivel bracket 120. FIG. 2 is intended to show the general positions of some of the components of the support device of a preferred embodiment of the present invention in association with the outboard motor.

Figure 3:
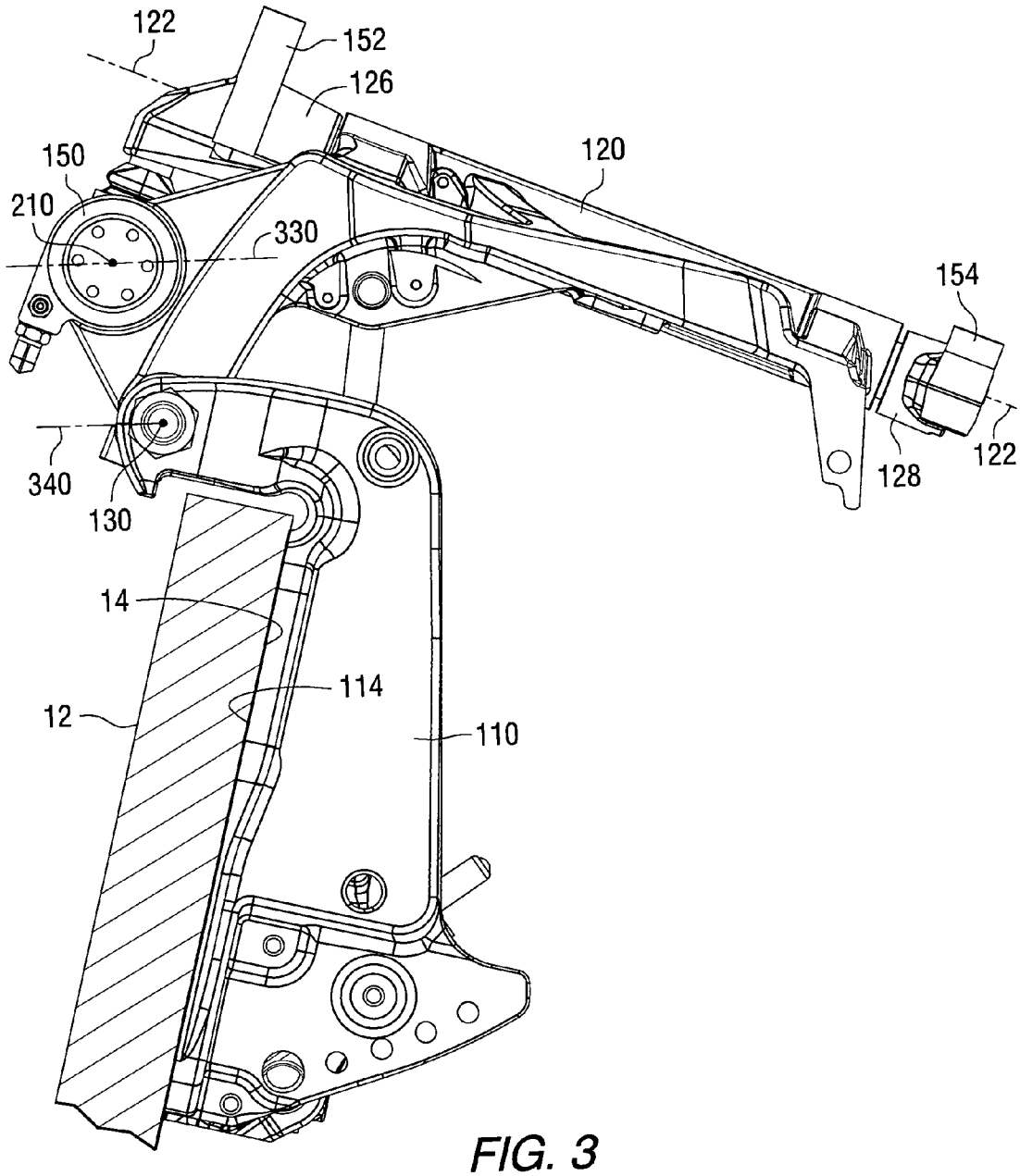
FIG. 3 is a side view of the present invention with its swivel bracket rotated upward relative to the transom bracket.

FIG. 3 illustrates the support device for a marine propulsion system made in accordance with a preferred embodiment of the present invention. In order to illustrate the relationship between portions of the support device, the swivel bracket 120 is illustrated in a tilted position, wherein the swivel bracket and steering axis 122 are rotated about the tilt axis 130. A swivel tube comprises a top end 126 and a bottom end 128 which are connected to opposite ends of a tube that is disposed within a cylindrical cavity formed in the swivel bracket 120. An upper mount 152 and a lower mount 154 allow the swivel tube to be attached to an outboard motor structure similar to the attachment techniques using mounts that are well known to those skilled in the art. The hydraulic steering cylinder 150 is preferably formed as an integral part of the swivel bracket 120. In addition, the steering cylinder 150 is located at a position, relative to the tilt axis 130, that does not interfere with the region in front of the transom 12 that is in the area identified by the dashed line circle 50 in FIG. 1.

With continued reference to FIG. 3, the transom bracket 110 is configured with a surface 114 that is attachable to a rear surface 14 of the transom 12. As can be seen, the steering axis 122 and the steering cylinder 150 are rotatable about the tilt axis 130.

Figure 4:
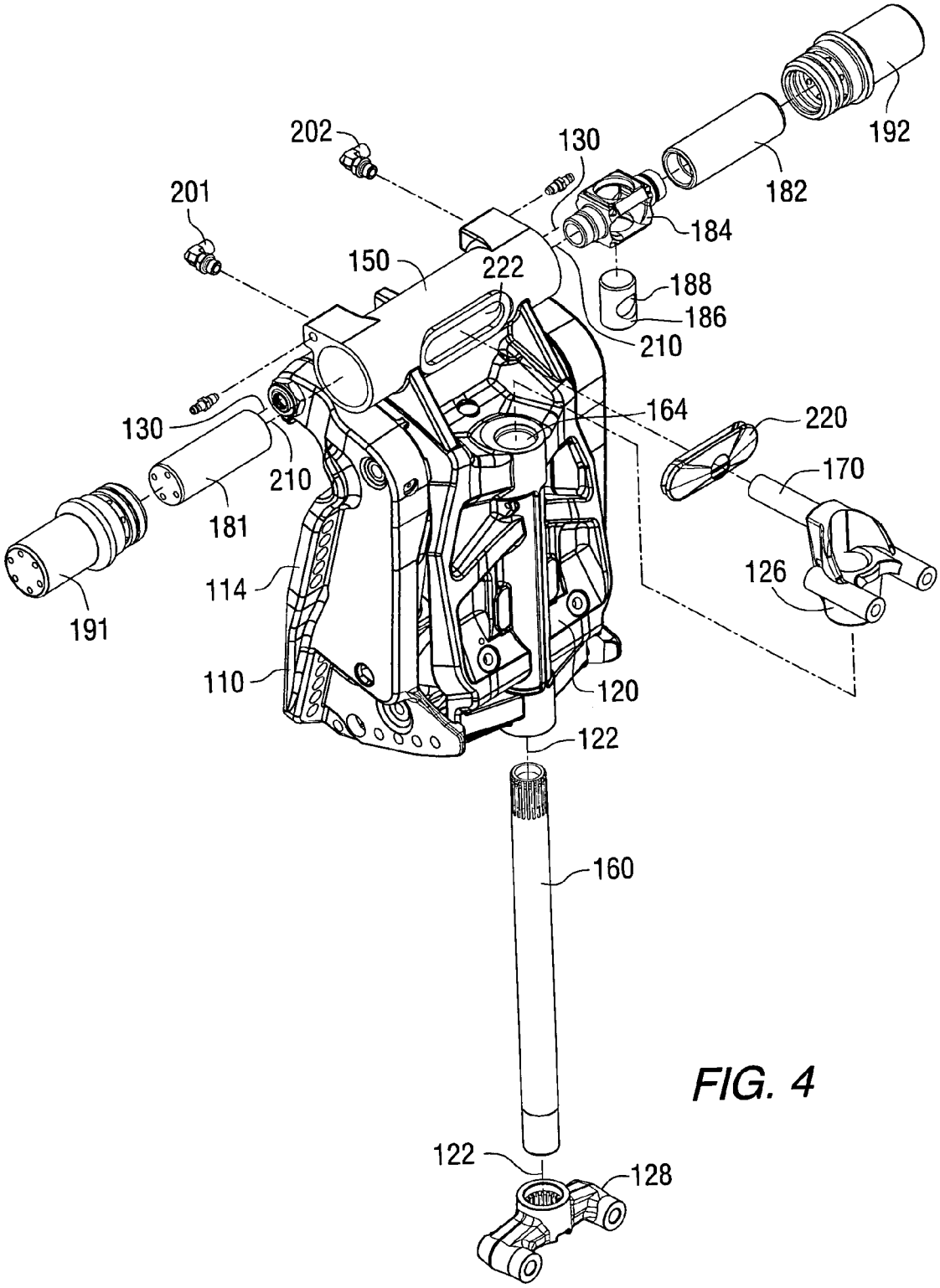
FIG. 4 is an exploded isometric view of the present invention.

FIG. 4 is an exploded isometric view of a support device for a marine propulsion system made in accordance with a preferred embodiment of the present invention. As described above, the transom bracket 110 is provided with a surface 114 that is configured to be placed against a rear surface of a transom of a marine vessel. The swivel bracket 120 is rotatable about the tilt axis 130. A top end 126 and a bottom end 128 of a tilt tube are attached together by the tube 160 shown in FIG. 4. That tube 160 is disposed within the cylindrical opening 164 formed in the swivel bracket 120. The upper end 126 of the swivel tube comprises a steering arm 170 which provides a connection to a piston within the steering cylinder 150. The interaction of the piston and the steering arm 170 will be described in greater detail below.

With continued reference to FIG. 4, a piston member is disposed within the internal cylindrical opening of the steering cylinder 150. The piston member comprises end portions 181 and 182 and a pivot support structure 184. A rotatable member 186 is disposed within the pivot support structure 184 and provided with an opening 188 which is shaped to receive the steering arm 170 therein. As a result, when the piston structure moves axially within the steering cylinder 150, the top end 126 of the swivel tube is caused to rotate about the steering axis which is coaxial with the central axis of the tube 160 and the cylindrical opening 164. Components identified by reference numerals 191 and 192 close and seal the ends of the steering cylinder 150. The fittings identified by reference numeral 201 and 202 provide a means by which hydraulic fluid can be introduced into the steering cylinder 150 at opposite ends of the piston structure to cause the piston to move in a direction along the central axis 210 of the steering cylinder 150. Reference numeral 220 in FIG. 4 identifies an elastomeric cover through which the steering arm 170 extends. This elastomeric cover is shaped to provide a seal over the opening 222 in the steering cylinder 150.

Figure 5:
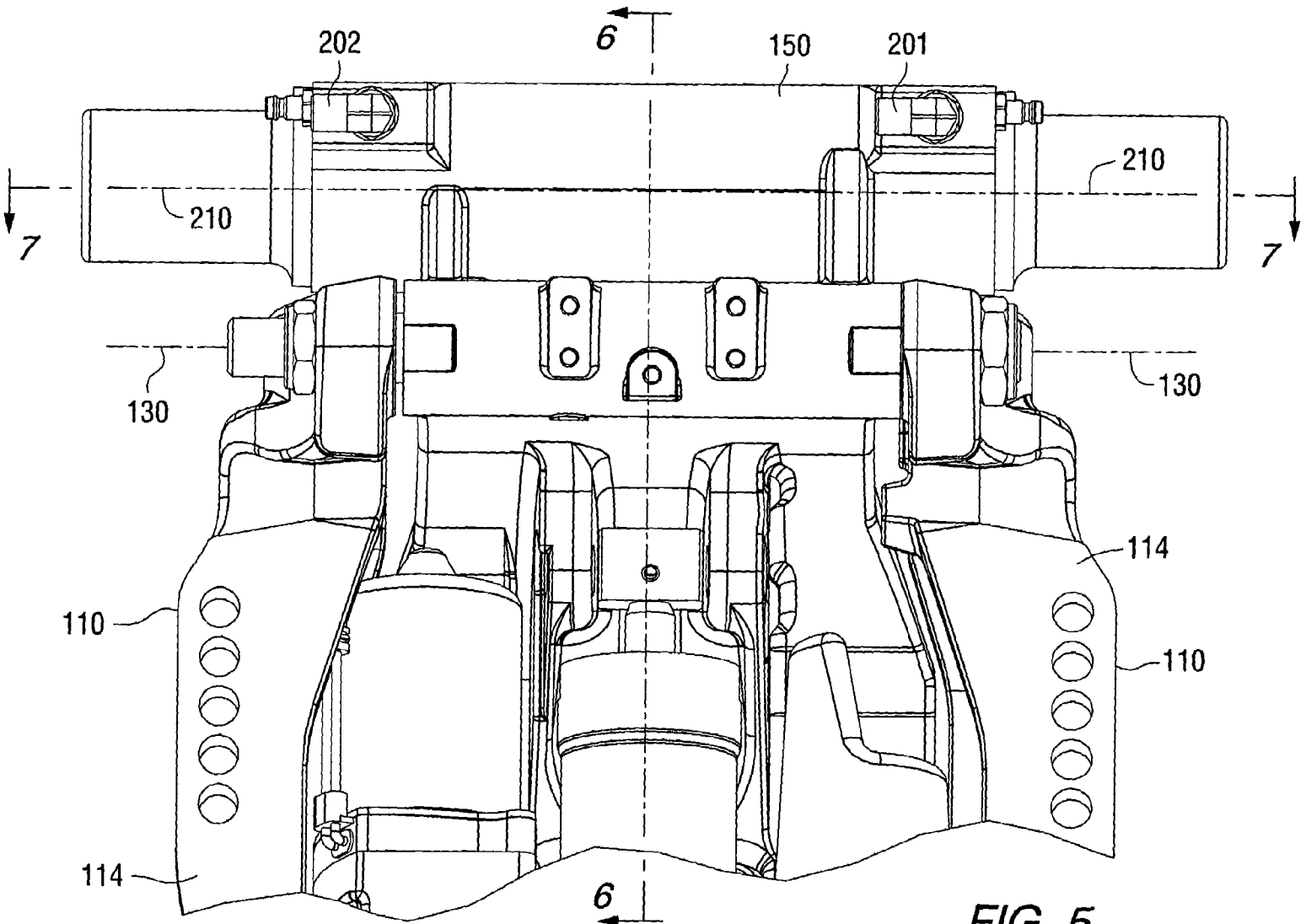
FIG. 5 is a partial view of the present invention seen from a position in front of the marine propulsion system.

FIG. 5 is a partial view of the support device of the present invention showing the surface 114 of the transom bracket 110 with holes that allow the transom bracket 110 to be rigidly attached to a transom of a marine vessel. The steering cylinder 150 is shown with its central axis 210. In addition, the tilt axis 130 is identified in FIG. 5.

Figure 6:
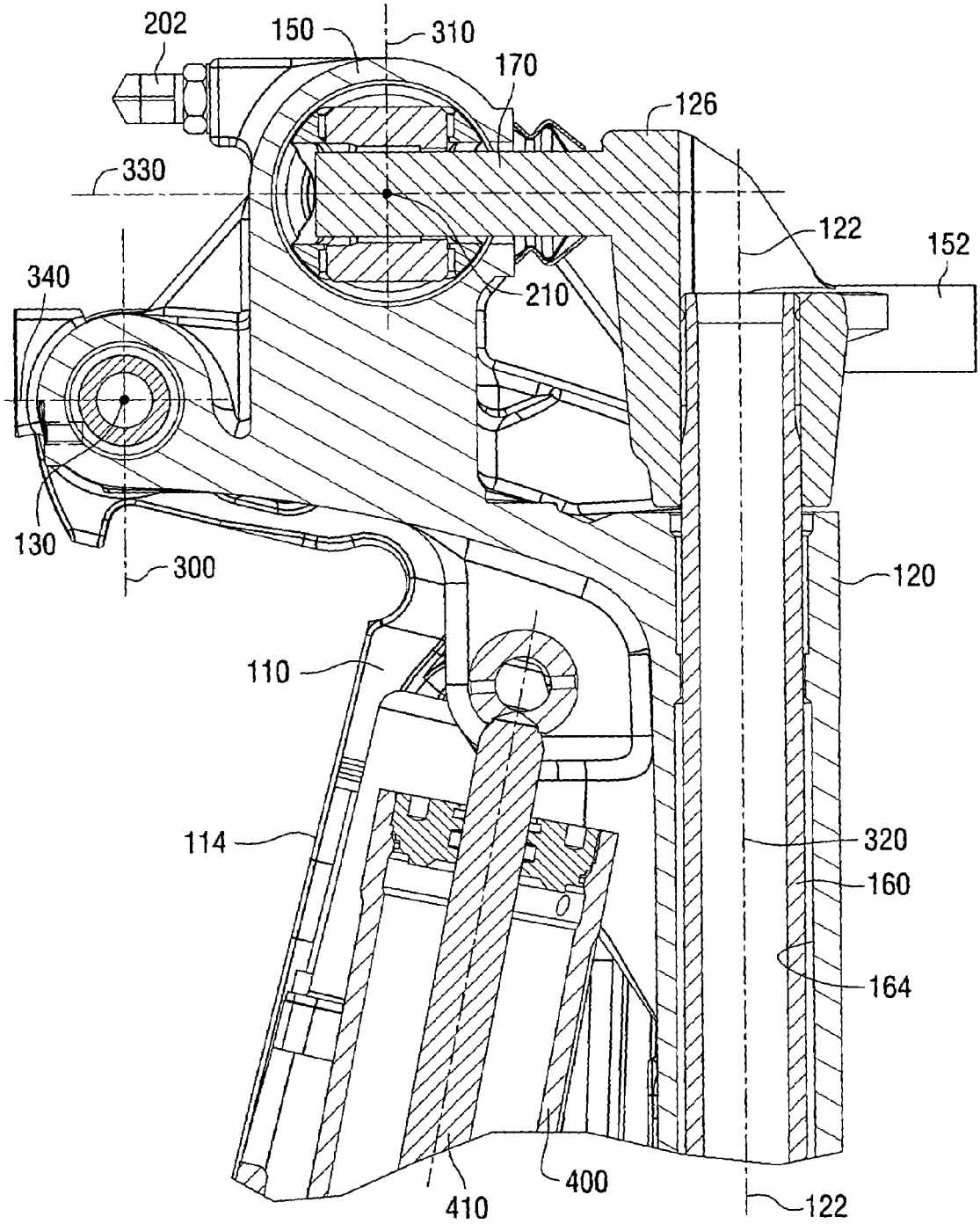
FIG. 6 is a section view of FIG. 5.

FIG. 6 is a section view of the device illustrated in FIG. 5. As can be seen, the tilt axis 130 is disposed within a generally vertical tilt plane 300, the central axis 210 of the steering cylinder 150 is disposed within a central plane 310 and the steering axis 122 is disposed within a steering plane 320. These planes are used to identify the relative positions and configurations of various important portions of the present invention. In FIG. 6, the tilt plane 300, the central plane 310 and the steering plane 320 are all perpendicular to the illustration and generally vertical with respect to the support device when surface 114 of the transom bracket 110 is attached to the rear surface of a transom of a boat and the steering axis 122 is vertical. As can be seen, the steering plane 320 is generally parallel to the tilt plane 300 and the central plane 310 is disposed between the tilt plane 300 and the steering plane 320 when the steering axis 122 is generally vertical. In other words, when the swivel bracket 120 is rotated about the tilt axis 130 so that the steering axis 122 is generally vertical, the central plane 310 is parallel with, and disposed between, the tilt plane 300 and the steering plane 320. This relative position of the central plane 310 of the hydraulic cylinder 150, relative to the tilt plane 300 and the steering plane 320, represents a significant distinction between the present invention and hydraulic steering systems that are known to those skilled in the art. A comparison of the prior art device shown in FIG. 1 and the present invention shown in FIG. 6 illustrates the significant difference in location between the steering cylinder 150 in FIG. 6 and the location, represented by dashed circle 50, in FIG. 1 where the prior art hydraulic cylinders are typically located.

With continued reference to FIG. 6, the central axis 210 of the hydraulic cylinder 150 is disposed in a generally horizontal first plane 330 and the tilt axis 130 is disposed in a generally horizontal second plane 340. The first plane 330 is disposed above the second plane 340 when the steering axis 122 is generally vertical. In other words, when the swivel bracket 120 is trimmed downwardly (in a clockwise direction in FIG. 6) to cause the steering axis 122 to be generally vertical, the central axis 210 is above the tilt axis 130. This is significantly different from the configuration known to those skilled in the art and illustrated in FIG. 1. In addition to the configuration in which the first plane 330 is above the second plane 340, the central axis 210 is between the tilt plane 300 and the steering plane 320 when the steering axis 122 is generally vertical. Also shown in FIG. 6 is a trim cylinder 400 with the rod 410 extending upward from the cylinder 400 to an attachment point with the swivel bracket 120.

Figure 7:
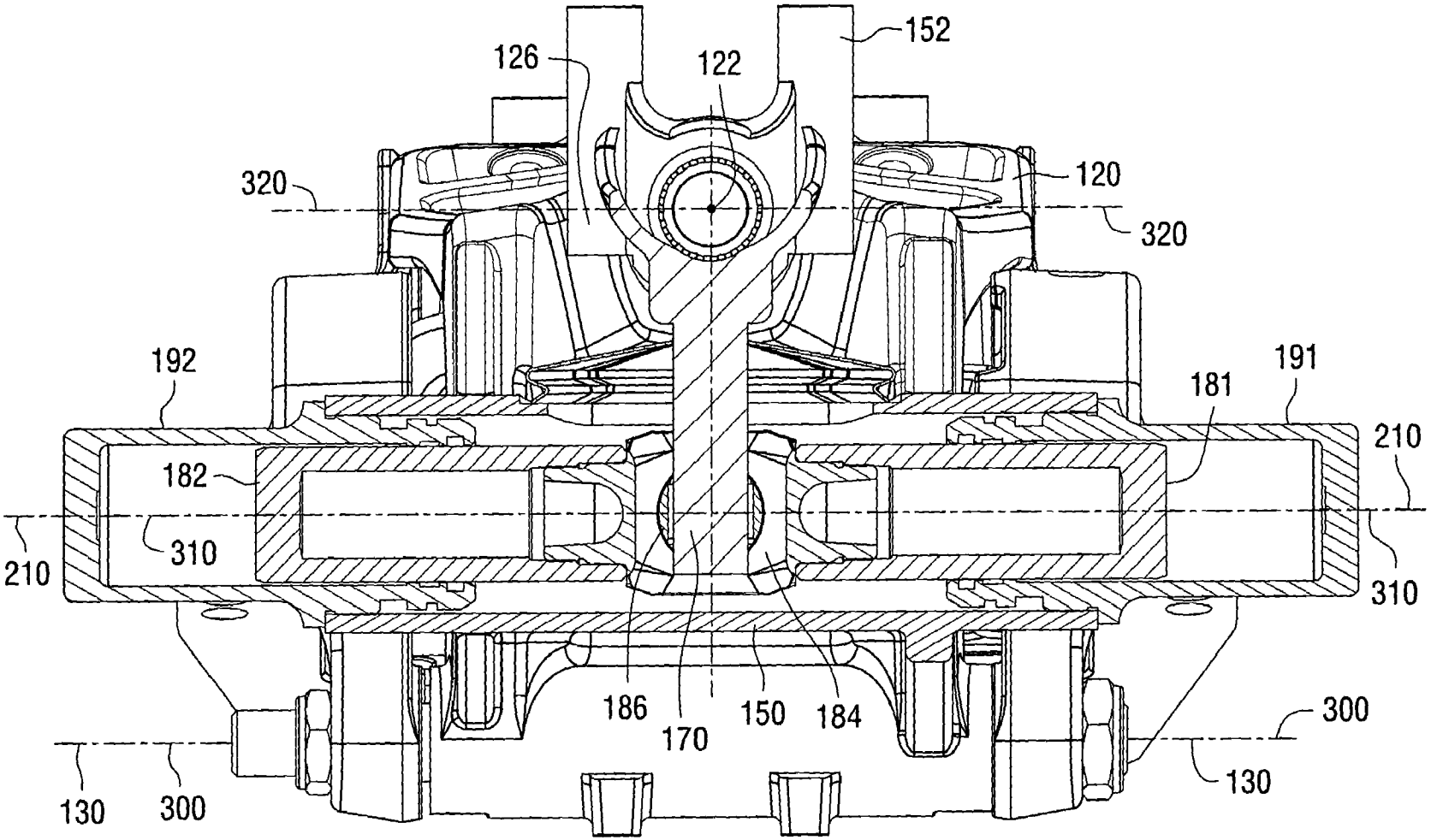
FIG. 7 is another section view of FIG. 5.

FIG. 7 is a section view of FIG. 5. The section view is taken through the center of the steering cylinder 150. The piston structure is illustrated within the cylinder 150. The two end portions 181 and 182 of the piston structure are attached to the pivot support structure 184. The pivot member 186 is supported for rotation by the pivot support structure. The steering arm 170 extends through the opening 188, which is illustrated in FIG. 4, so that movement of the piston structure along the central plane 310 of the hydraulic cylinder 150 causes rotation of the swivel tube about the steering axis 122.

FIG. 7 also illustrates the relationship between the central plane 310 in which the central axis 210 of the hydraulic cylinder 150 is disposed, the tilt plane 300 and the steering plane 310. As can be seen in FIG. 7, and also in FIG. 6, the central plane 310 is parallel to and between the tilt plane 300 and the steering plane 320 when the steering axis 122 is generally perpendicular.

Figure 8:
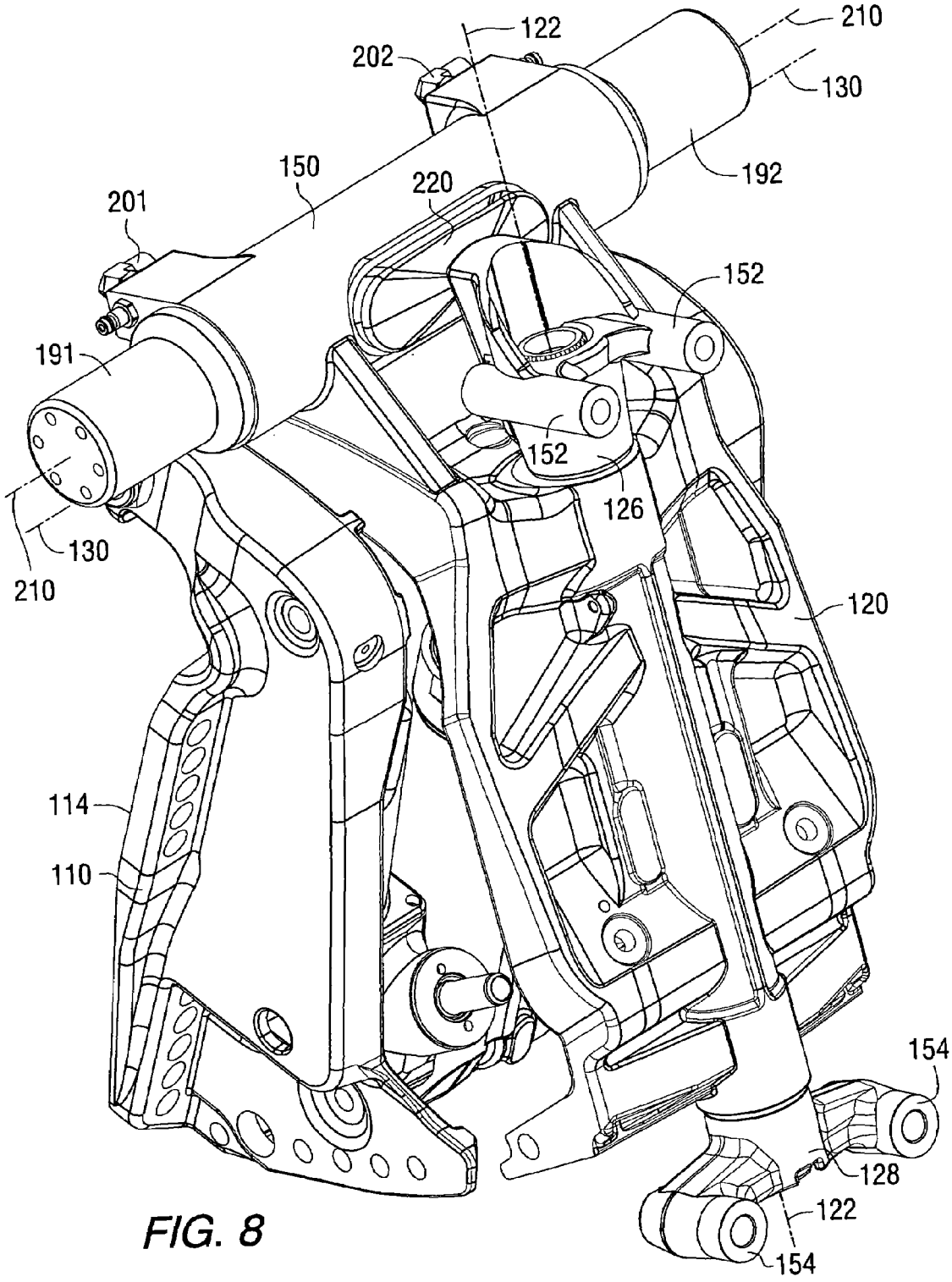
FIG. 8 is an isometric view of the present invention with the swivel bracket rotated slightly about the tilt axis.

FIG. 8 is an isometric view of the support device of a preferred embodiment of the present invention. To illustrate the rotatability of the swivel bracket 120 about the tilt axis 130 relative to the transom bracket 110, the swivel bracket 120 in FIG. 8 is shown in the position that it would assume when the outboard motor is trimmed slightly toward the position represented in FIG. 3. In order to illustrate the various portions and components of the present invention, the outboard motor is not illustrated in FIG. 8. However, it should be understood that the outboard motor, as represented by the cowl members in FIG. 2, would be attached to the support mounts identified by reference numerals 152 and 154 in FIG. 8. The steering axis 122 is no longer in a generally vertical position when the swivel bracket 120 is rotated about the tilt axis 130 as illustrated in FIG. 8. However, throughout its normal range of rotation of the swivel bracket 120 about the tilt axis 130, the central axis 210 of the hydraulic steering cylinder 150 remains above the tilt axis 130 as described above in conjunction with FIG. 6.

With continued reference to FIGS. 2-8, a marine propulsion system support device made in accordance with a preferred embodiment of the present invention comprises a swivel bracket 120 and a transom bracket 110 which is attachable to a marine vessel. The swivel bracket 120 is supported by the transom bracket 110 for rotation about a tilt axis 130. The steering axis 122 is rotatable about the tilt axis as illustrated in FIGS. 3 and 8. In a particularly preferred embodiment of the present invention, a hydraulic steering cylinder 150 is attached to the swivel bracket 120 and is formed as an integral part of the swivel bracket. A piston structure, as illustrated in FIG. 7, is disposed within the steering cylinder 150 for movement within the steering cylinder 150 along a path which is parallel to a central axis 210 of the steering cylinder 150. A steering arm 170 is attached to the swivel tube which is rotatably supported by the swivel bracket 120. The steering arm 170 is movable, by the piston, to cause the swivel tube to rotate about the steering axis 122 relative to the swivel bracket 120. The tilt axis 130 is disposed within a generally vertical tilt plane 300. The central axis 210 of the steering cylinder 150 is disposed within a central plane 310. The steering axis 122 is disposed within a steering plane 320. The steering plane 320 is generally parallel to the tilt plane 300 and the central plane 310 is disposed between the tilt plane 300 and the steering plane 320 when the steering axis 122 is generally vertical as illustrated in FIGS. 6 and 7. An engine, which is disposed under the cowl 142 but not illustrated in FIG. 2, is supported by the swivel bracket 120 for rotation about a steering axis 122. The steering arm 170 is attached to the engine through the use of mounts, 152 and 154, as illustrated in FIGS. 4 and 8. The central axis 210 is disposed in a generally horizontal first plane 330 and the tilt axis 130 is disposed in a generally horizontal second plane 340. The first plane 330 is above the second plane 340, as illustrated in FIG. 6 even when the swivel bracket 120 is rotated in a counterclockwise direction about the tilt axis 130 as illustrated in FIG. 3. The engine of the outboard motor is attachable to the swivel bracket 120 by its attachment to the mounts, 152 and 154, of the swivel tube 160. The steering arm 170 is attached to the swivel tube 160 through its attachment to the top end 126 of the swivel tube. The steering cylinder 150 is formed as an integral part of the swivel bracket 120 in a particularly preferred embodiment of the present invention. However, it should be understood that the hydraulic cylinder 150 could be a separate component that is attached to the swivel bracket to achieve the characteristics of the present invention described above. The tilt plane 300 is generally parallel to the central plane 310 when the steering axis 122 is generally vertical, as described above in conjunction with FIGS. 6 and 7.

Although the present invention has been described with particular specificity and illustrated to show a preferred embodiment, it should be understood that alternative embodiments are also within its scope.

We claim:

1. A marine propulsion device, comprising:

an engine;

a swivel bracket, said engine being supported by said swivel bracket for rotation about a steering axis;

a transom bracket which is attachable to a marine vessel, said swivel bracket being supported by said transom bracket for rotation about a tilt axis, said steering axis being rotatable about said tilt axis;

a steering cylinder attached to said swivel bracket;

a piston disposed within said steering cylinder for movement within said steering cylinder along a path which is parallel to a central axis of said steering cylinder; and a steering arm attached to said engine, said steering arm being movable by said piston to cause said engine to rotate about said steering axis, said tilt axis being disposed within a tilt plane, said central axis of said steering cylinder being disposed within a central plane, said steering axis being disposed within a steering plane, said steering plane being generally parallel to said tilt plane, said central plane being disposed between said tilt plane and said steering plane.

2. The device of claim 1, wherein:

said central axis is disposed in a generally horizontal first plane; and said tilt axis is disposed in a generally horizontal second plane, said first plane being disposed above said second plane.

3. The device of claim 1, further comprising:

a swivel tube rotatably supported by said swivel bracket.

4. The device of claim 3, wherein:

said engine is attached for support to said swivel tube.

5. The device of claim 4, wherein:

said steering arm is attached to said swivel tube.

6. The device of claim 1, wherein:

said steering cylinder is formed as an integral portion of said swivel bracket.

7. The device of claim 1, wherein:

said tilt plane and said steering plane are generally parallel to each other and to said central plane when said steering axis is generally vertical.

8. The device of claim 1, wherein:

said central axis and said steering axis are rotatable with said swivel bracket about said tilt axis.

9. The device of claim 1, wherein:

said central axis is behind said tilt axis when said steering axis is generally vertical.

10. A marine propulsion system support device, comprising:

a swivel bracket;

a swivel tube rotatably supported by said swivel bracket for rotation about a steering axis;

a transom bracket which is attachable to a marine vessel, said swivel bracket being supported by said transom bracket for rotation about a tilt axis, said steering axis being rotatable about said tilt axis;

a steering cylinder attached to said swivel bracket;

a piston disposed within said steering cylinder for movement within said steering cylinder along a path which is parallel to a central axis of said steering cylinder; and a steering arm attached to said swivel tube, said steering arm being movable by said piston to cause said swivel tube to rotate about said steering axis relative to said swivel bracket, said tilt axis being disposed within a generally vertical tilt plane, said central axis of said steering cylinder being disposed within a central plane, said steering axis being disposed within a steering plane, said steering plane being generally parallel to said tilt plane and said central plane being disposed between said tilt plane and said steering plane when said steering axis is generally vertical.

11. The device of claim 10, further comprising:

an engine, said engine being supported by said swivel bracket for rotation about a steering axis, said steering arm being attached to said engine.

12. The device of claim 10, wherein:

said central axis is disposed in a generally horizontal first plane; and said tilt axis is disposed in a generally horizontal second plane, said first plane being disposed above said second plane.

13. The device of claim 11, wherein:

said engine is attached for support to said swivel tube.

14. The device of claim 10, wherein:

said steering arm is attached to said swivel tube.

15. The device of claim 10, wherein:

said steering cylinder is formed as an integral portion of said swivel bracket.

16. The device of claim 10, wherein:

said tilt plane is generally parallel to said central plane when said steering axis is generally vertical.

17. A marine propulsion system support device, comprising:

a swivel bracket;

a swivel tube rotatably supported by said swivel bracket for rotation about a steering axis;

a transom bracket which is attachable to a marine vessel, said swivel bracket being supported by said transom bracket for rotation about a tilt axis, said steering axis being rotatable about said tilt axis;

a steering cylinder formed as an integral portion of said swivel bracket;

a piston disposed within said steering cylinder for movement within said steering cylinder along a path which is parallel to a central axis of said steering cylinder; and a steering arm attached to said swivel tube, said steering arm being movable by said piston to cause said swivel tube to rotate about said steering axis relative to said swivel bracket, said tilt axis being disposed within a generally vertical tilt plane, said central axis of said steering cylinder being disposed within a central plane, said steering axis being disposed within a steering plane, said steering plane being generally parallel to said tilt plane, said central plane being disposed between said tilt plane and said steering plane when said steering axis is generally vertical, said central axis being disposed in a generally horizontal first plane, said tilt axis being disposed in a generally horizontal second plane, said first plane being disposed above said second plane, said steering arm being attached to said swivel tube.

18. The device of claim 17, wherein:

said tilt plane is generally parallel to said central plane when said steering axis is generally vertical.

19. The device of claim 18, further comprising:

an engine, said engine being supported by said swivel bracket for rotation about a steering axis, said steering arm being attached to said engine.

20. The device of claim 19, wherein:

said engine is attached for support to said swivel tube.

21. A marine propulsion system support device, comprising:

a transom bracket which is attachable to a marine vessel;

a swivel bracket, said swivel bracket being supported by said transom bracket for rotation about a tilt axis, a steering axis being rotatable about said tilt axis;

a hydraulic steering cylinder formed as an integral portion of said swivel bracket;

a swivel tube rotatable supported by said swivel bracket;

a piston disposed within said steering cylinder for movement within said steering cylinder along a path which is parallel to a central axis of said steering cylinder; and a steering arm attached to said swivel tube, said steering arm being movable by said piston to cause said swivel tube to rotate about said steering axis relative to said swivel bracket, said tilt axis being disposed within a generally vertical tilt plane, said central axis of said steering cylinder being disposed within a central plane, said steering axis being disposed within a steering plane, said steering plane being generally parallel to said tilt plane, said central plane being disposed between said tilt plane and said steering plane when said steering axis is generally vertical, said central axis being disposed in a generally horizontal first plane, said tilt axis being disposed in a generally horizontal second plane, said first plane being disposed above said second plane, said steering arm being attached to said swivel tube, said tilt plane being generally parallel to said central plane when said steering axis is generally vertical.

22. The device of claim 21, further comprising:

an engine, said engine being supported by said swivel bracket for rotation about a steering axis, said steering arm being attached to said engine.

23. The device of claim 22, wherein:

said engine is attached for support to said swivel tube.

* * * * *